US005841614A

United States Patent [19]

Perret

[11] Patent Number: 5,841,614

[45] Date of Patent: Nov. 24, 1998

[54] HIGH VOLTAGE CIRCUIT BREAKER WITH INSERTION OF RESISTANCE ON CLOSURE

[75] Inventor: Michel Perret, Bourgoin-Jallieu, France

[73] Assignee: GEC Alsthom T & D SA, Paris, France

[21] Appl. No.: 853,253

[22] Filed: May 9, 1997

[30] Foreign Application Priority Data

May 13, 1996 [FR] France ..... 96 05910

[51] Int. Cl.[6] ..... H01H 9/30

[52] U.S. Cl. ..... 361/14; 361/116; 218/143

[58] Field of Search ..... 361/2, 14, 115, 361/116, 123; 218/10, 11, 13, 15, 17–19, 51, 53, 63, 57, 108, 116, 143; 200/16 B, 166

[56] References Cited

U.S. PATENT DOCUMENTS 4,338,500 7/1982 Pham Van et al. ..... 218/143

5,164,559 11/1992 Pham et al. ..... 218/143

*Primary Examiner*—Ronald W. Leja

*Attorney, Agent, or Firm*—Sughrue, Mion, Zinn, Macpeak & Seas, PLLC

[57] ABSTRACT

A high voltage circuit breaker with insertion of resistance on closing, wherein the resistance is inserted by a fixed insertion electrode co-operating with the end of the moving main contact, the blast nozzle and the arcing contact of the moving assembly being secured to each other, and the subassembly being movable relative to the moving assembly so that on triggering, because of the inertia of said subassembly, the arcing contacts separate after the insertion electrode and the end of the moving main contact have moved sufficiently far apart.

2 Claims, 7 Drawing Sheets

HIGH VOLTAGE CIRCUIT BREAKER WITH INSERTION OF RESISTANCE ON CLOSURE

The present invention relates to a high voltage circuit breaker comprising, for each pole, a cylindrical enclosure filled with insulating gas, with interrupter members being disposed therein, together with an axially-disposed resistor associated with means for inserting it temporarily into the circuit while the circuit breaker is closing.

BACKGROUND OF THE INVENTION

French patent application No. 79/05 478, describes a circuit breaker having an interrupter chamber in which there are disposed a resistor and means for inserting said resistor temporarily in the circuit of the circuit breaker during an engagement operation. Those means comprise a contact secured to the moving equipment, but movable relative thereto. That is why the contact is known as a "semi-moving" contact. Generally the semi-moving contact is a piece of solid tungsten since it needs to withstand the shock of a closure operation. The contact is therefore of a mass which constitutes a large fraction of the mass of the moving equipment, thereby contributing to the need for increasing the power required to drive the circuit breaker. Also, the closure contact is very bulky, which means that the enclosure must be of large diameter.

Unfortunately, manufacturers are all seeking to reduce driving power requirements, so as to reduce the investment and running costs of a circuit breaker.

OBJECTS AND SUMMARY OF THE INVENTION

A first object of the invention is to provide a circuit breaker of the above type in which the resistance-inserting means are of reduced weight, thereby enabling the driving power to be reduced.

Another object of the invention is to provide a circuit breaker of the above type in which the resistance-insertion means are of reduced volume, thereby making it possible to use enclosures of smaller diameter.

The present invention provides a circuit breaker as defined in the claims.

BRIEF DESCRIPTION OF THE DRAWINGS

The invention will be well understood from the following description of a preferred embodiment, given with reference to the accompanying drawings, in which.

DETAILED DESCRIPTION OF THE INVENTION

In the description below, only one circuit breaker pole is described, it being understood that the invention applies to a three-phase circuit breaker having three identical poles.

The circuit breaker pole described is of the bare type, but the invention naturally also applies to circuit breakers within grounded metal cladding.

Figure 1:
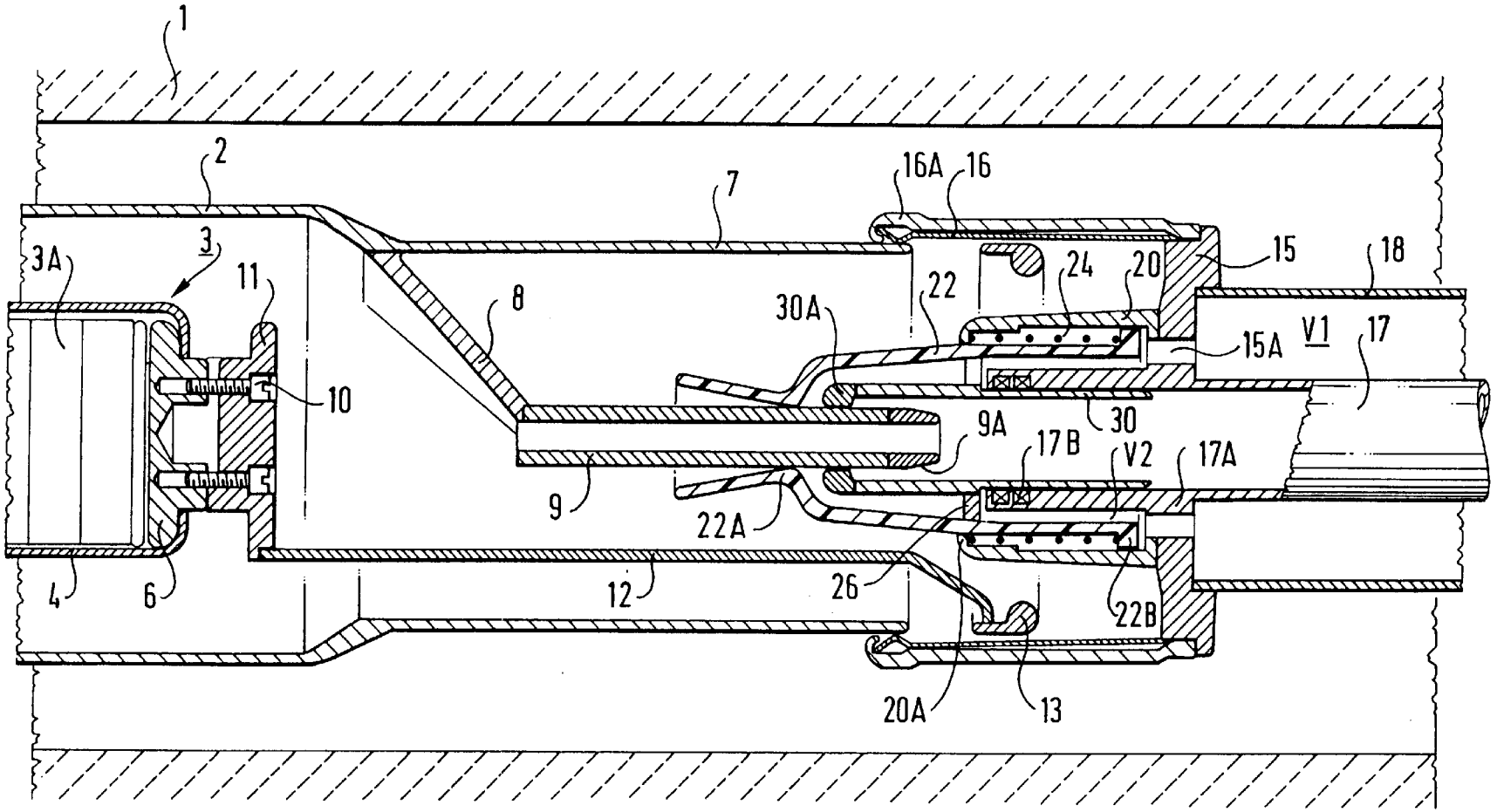
FIG. 1 is a fragmentary axial section view through one pole of a circuit breaker of the invention, shown in the engaged position.

In FIG. 1, reference 1 designates an enclosure, e.g. made of ceramic, filled with a gas having good dielectric properties, such as sulfur hexafluoride $SF_6$.

The interrupter chamber includes a fixed assembly comprising a fixed metal cylinder 2 connected to a first current terminal (not shown). A "closure" resistor 3 is disposed axially in the enclosure 1; it is constituted by a stack of disks 3A surrounded by an insulating side sheath 4; a first end of the stack is connected to the above-mentioned first current terminal; the other end of the stack is terminated by a metal end plate 6.

A metal tube 7 is fixed to the metal cylinder 2 and constitutes the fixed main contact of the circuit breaker; metal arms 8 serve to fix a metal tubular portion 9 to the same cylinder 2, with the end 9A of the tubular portion being made of an alloy that withstands the effects of electric arcing. This tubular portion 9–9A constitutes the fixed arcing contact of the circuit breaker.

A metal piece 11 is fixed to the end plate 6, preferably by means of screws 10, with the piece 11 carrying metal arms 12 parallel to the axis of the enclosure; there are preferably two such arms; a metal ring 13 is welded to the ends of these arms and constitutes a fixed electrode for inserting the resistor 3 during closure.

The moving assembly of the circuit breaker comprises a circular metal end plate 15 disposed perpendicularly to the axis of the enclosure.

This metal end plate 15 carries a ring of contact fingers 16 constituting the moving main contacts which co-operate with the tube 7. The fingers 16 are protected by an anticorona cap 16A.

The side of the end plate 15 facing away from the contacts 16 is connected to two cylinders that are coaxial about the axis of the enclosure. These cylinders, referenced as 17 and 18 define a blast volume V1 in which a fixed blast piston is disposed (not shown). One of the cylinders, e.g., the inner cylinder 17, is mechanically connected to a drive rod (not shown); the other cylinder, 18, is electrically connected by sliding contacts (not shown) to a second current terminal (not shown).

The inner cylinder 17 is extended through the end plate 15 by a cylindrical portion 17A provided on the inside with sliding contacts 17B.

A cylindrical portion 20 secured to the end plate 15 is disposed coaxially around the cylindrical portion 17A. The cylindrical portions 17A and 20 together define an annular volume V2 in which there moves the end of a blast nozzle 22 made of insulating material. As in conventional circuit breaker nozzles, the nozzle 22 has a throat 22A, however it is terminated by a ring 22B which constitutes a shoulder facilitating sliding thereof in the volume V2. A spring 24 bears firstly against the shoulder 22B and secondly on a shoulder 20A at the end of the cylindrical portion 20.

The nozzle 22 is connected by a ring 26 to a metal tubular portion 30 constituting a semi-moving arcing contact co-operating with the fixed arcing contact 9–9A. The portion 30 is terminated at one end by a contact piece 30A made of an alloy that withstands the effects of electric arcing.

It may be observed that the end plate 15 includes passages 15A to allow the blast gas to pass from the volume V1 to the volume V2 during an opening operation.

The circuit breaker operates as follows.

Under normal operating conditions, the circuit breaker is in the configuration shown in FIG. 1. The permanent current passes via the first current contact, the cylinder 2, the tube 7, the fingers 16, the end plate 15, the tube 18, and the second current terminal.

The circuit breaker is triggered by moving its moving assembly under drive from the circuit breaker control means (not shown) directed towards the right of FIG. 1.

Figure 2:
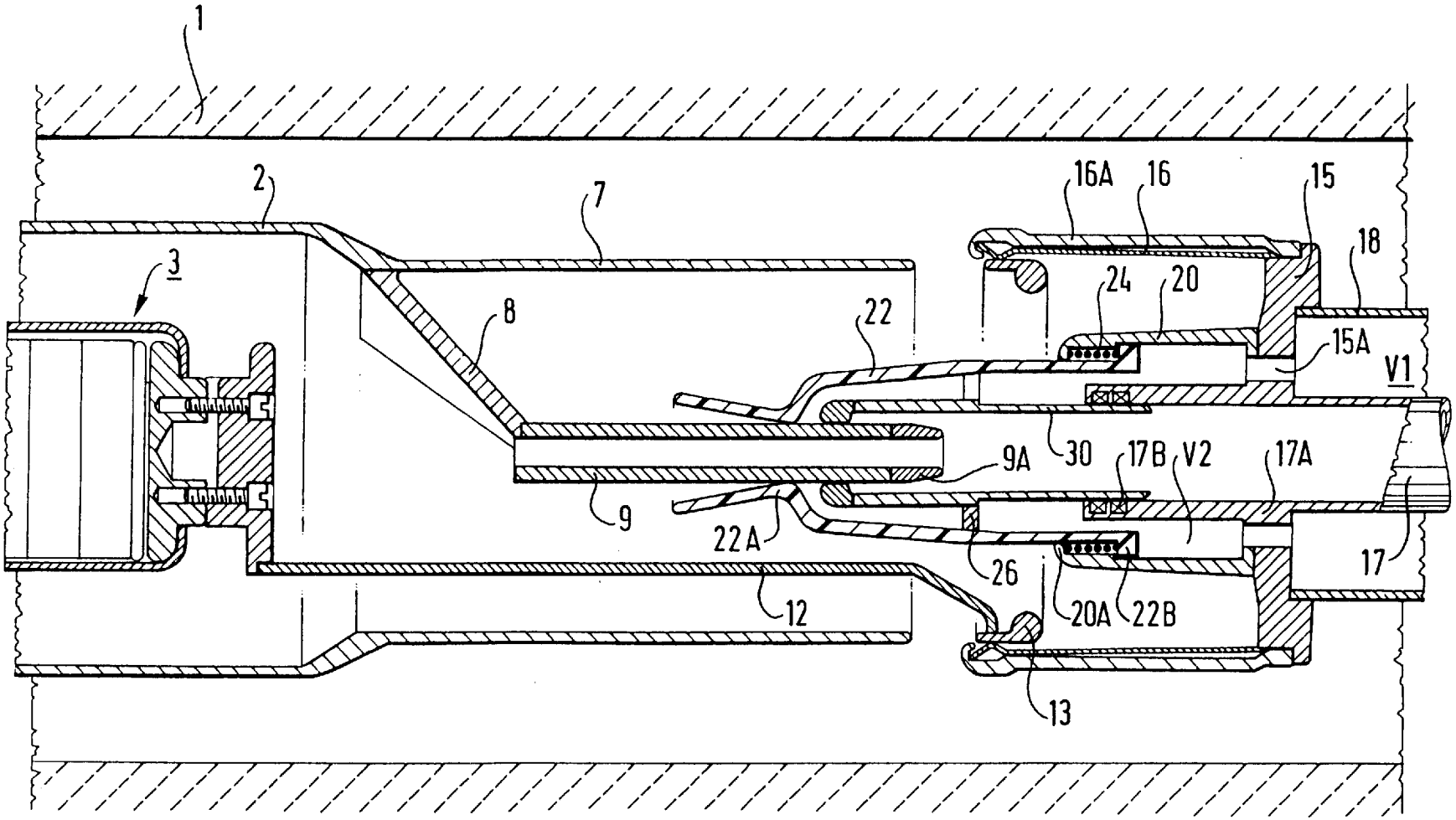
FIGS. 2 to 5 are similar views of the circuit breaker during the various stages of an opening operation.

In a first stage, as shown in FIG. 2, the moving assembly is moved a few tens of millimeters to the right. By inertia, and also because of the increase in the pressure in the volume V2 behind the ring 22B, due to the gas in the volume V1 being compressed, the semi-moving subassembly constituted by the nozzle 22 and the arcing contact 30–30A remains in the position it occupies in the configuration of FIG. 1. This enables the main contacts 7 and 16 to separate, with the current then switching to flow through the arcing contacts 9–9A and 30–30A. During this movement, the spring 24 is compressed.

Figure 3:
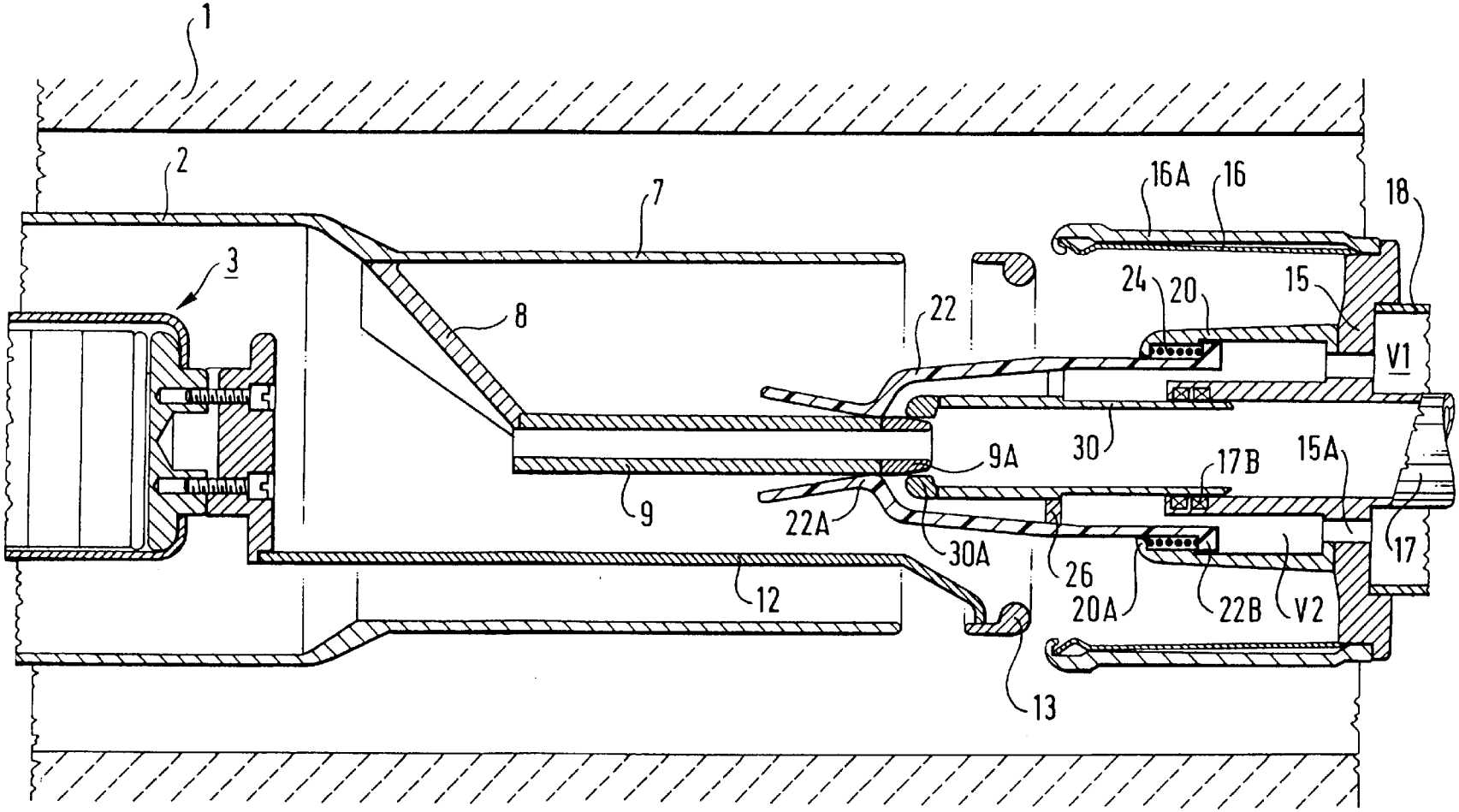

After the moving equipment has moved further, the contacts 16 have gone past the insertion electrode 13 and the arcing contacts 9–9A and 30–30A are on the point of separating (see FIG. 3) since, with the spring being fully compressed, the arcing contact 30–30A of the semi-moving subassembly is being driven by the moving assembly.

Figure 4:
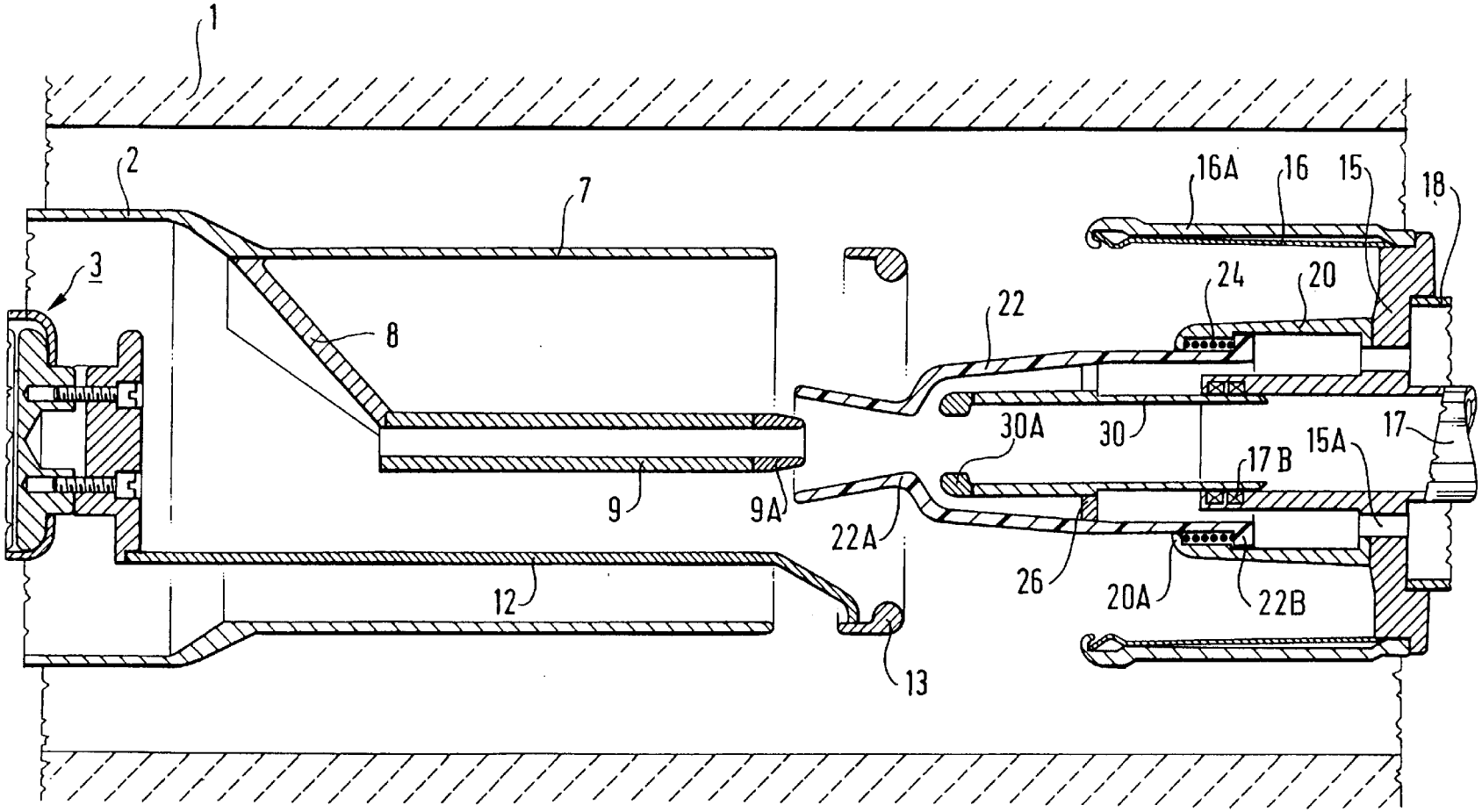

After the arcing contacts have separated (FIG. 4) an arc is struck between these contacts, but it is rapidly extinguished by energetic blasting through the nozzle 22.

The pressure in the volume V2 falls off rapidly and, under the effect of the spring, the semi-moving subassembly constituted by the nozzle 22 and the arcing contact 30–30A returns to its initial position relative to the moving assembly.

Figure 5:
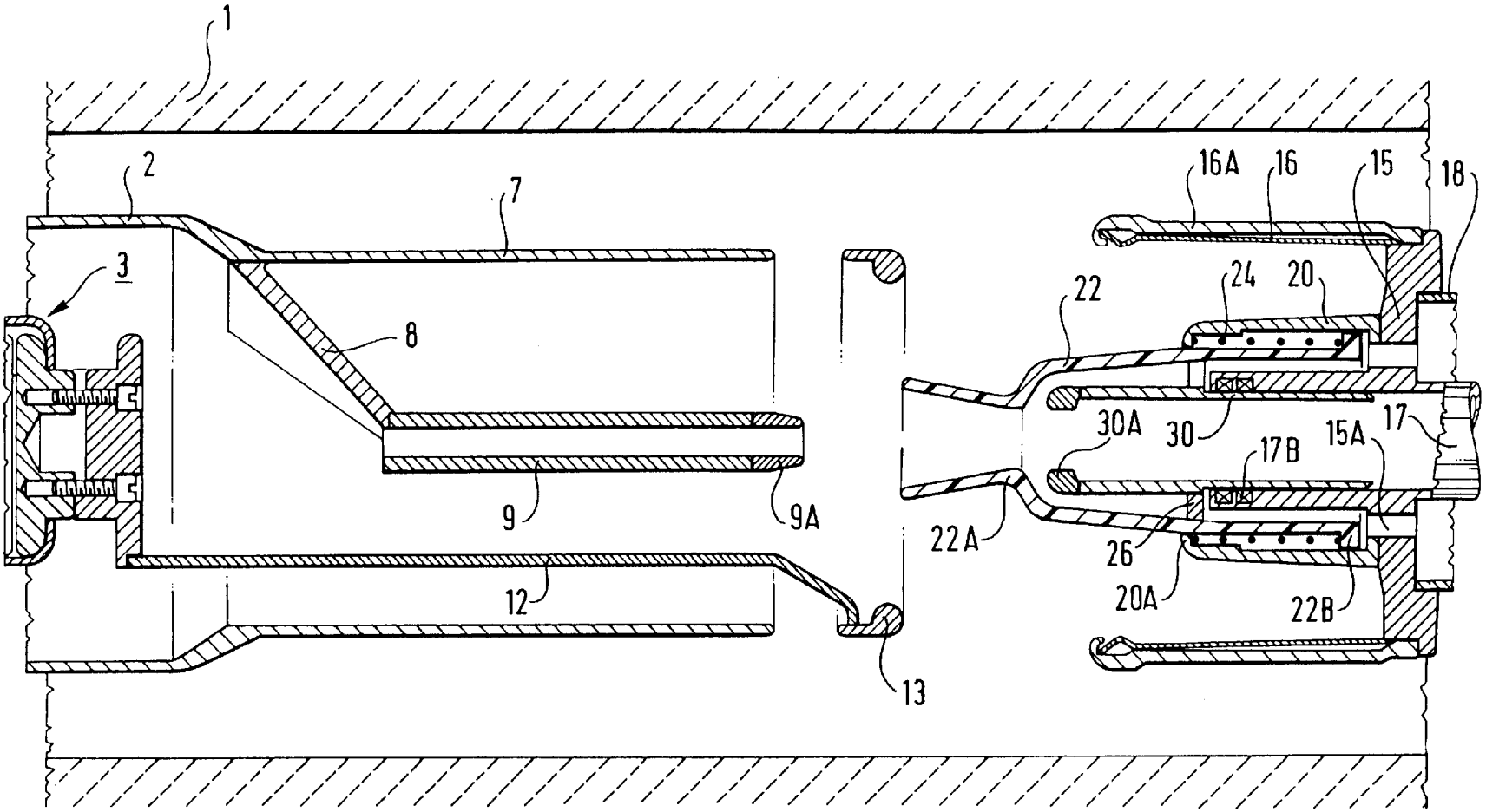

At the end of the opening maneuver, the circuit breaker is in its open position as shown in FIG. 5. The voltage is held between the ends of the contacts 9A and 30A, and also between the ends of the anticorona caps 16A and the electrode 13, because the insulation distances are sufficiently large. It should be observed that in the open configuration of the circuit breaker (FIG. 5), the distance between the end of the cap 16A of the moving main contact 16, and the electrode 13 is less than the distance between the respective ends 9A and 30A of the arcing contacts 9 and 30. It is this feature that makes it possible to insert the resistor 3 temporarily during the operation of closing the circuit breaker.

A closure maneuver comprises moving the moving equipment to the left.

Figure 6:
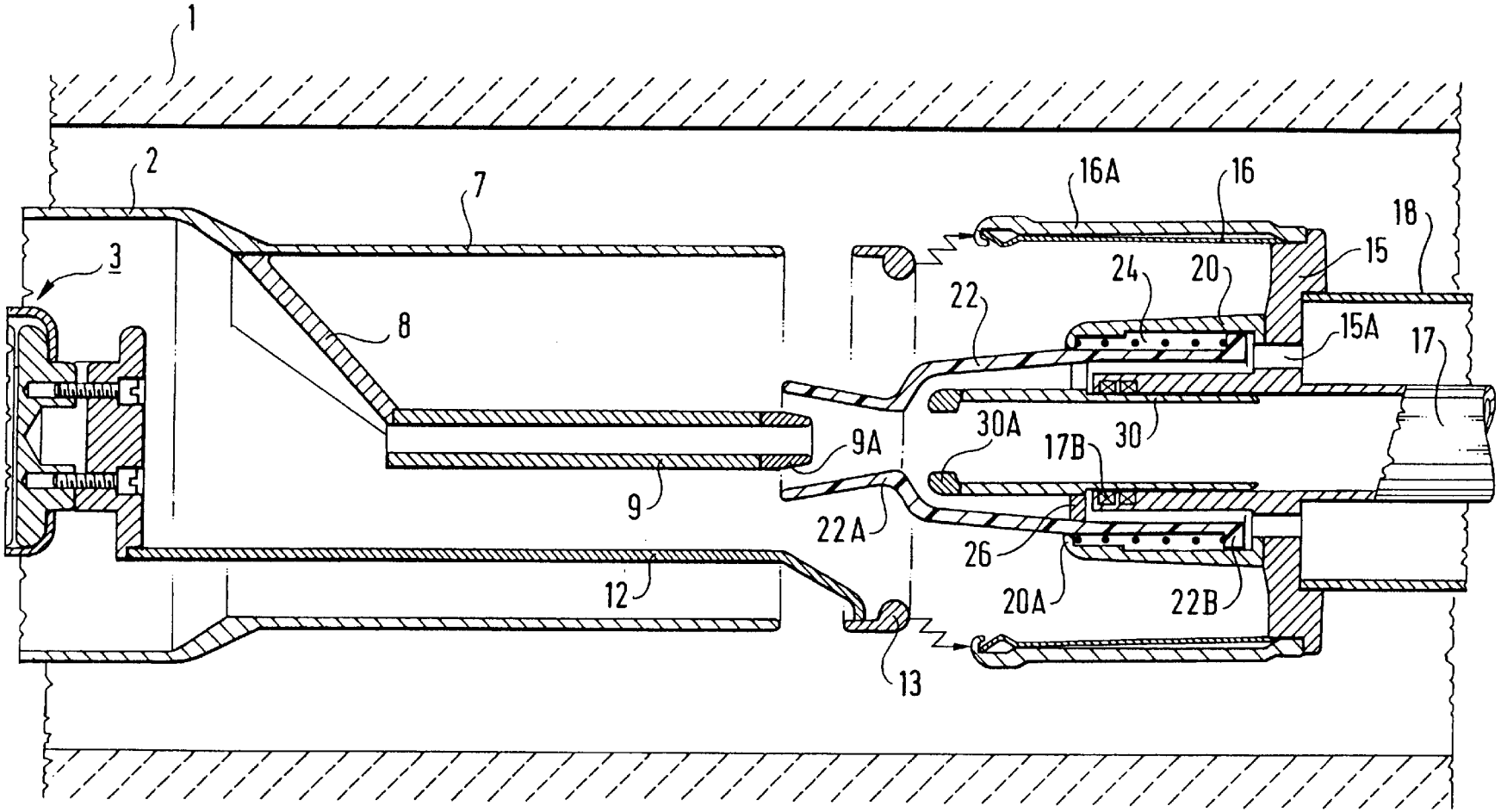
FIGS. 6 and 7 are similar views of the circuit breaker showing two successive stages in a closing operation.

It is the anticorona cap 16A that comes close first to the insertion electrode 13. When the distance between these two pieces becomes less than the insulation distance (FIG. 6), an arc is struck between the electrode 13 and the anticorona cap 16A, thereby inserting the resistor 3 in series in the circuit of the circuit breaker.

Figure 7:
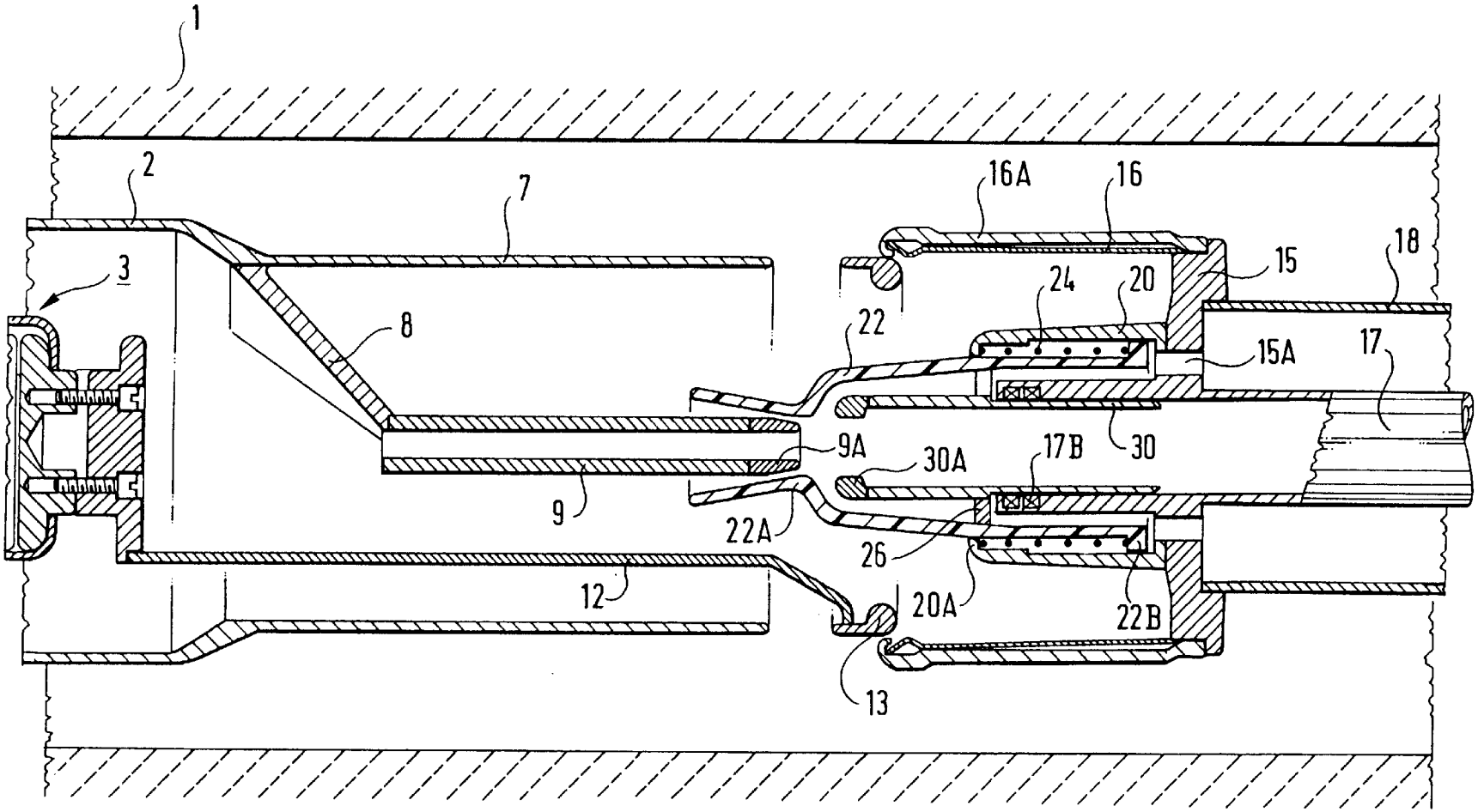

As the moving equipment continues to move, the distance between the ends 9A and 30A of the arcing contacts becomes less than the insulation distance (FIG. 7) and an arc is struck between these contacts, thereby short circuiting the resistor 3. The dimensions of the various elements of the circuit breaker and the speed with which the moving assembly moves are designed so that the insertion lasts for a duration lying in the range of 8 milliseconds to 10 milliseconds, which is the range specified by network utilities.

As the moving equipment continues to move, it returns to its initial position (FIG. 1).

The above-described means for inserting resistance during closure solve the technical problems mentioned in the preamble of the present text:

the mass of the elements connected to the moving assembly is reduced, with this being achieved since the additional masses come solely from lengthening the nozzle 22, the sliding contacts 18, and the spring 24, and together amounts to very little extra mass; and bulk is reduced with this problem being solved by the insertion electrode being of smaller diameter than the anticorona cap 16A of the ring of main contact fingers 16.

I claim:

1. A high voltage circuit breaker having an open position and a closed position, comprising, an enclosure containing a fixed main contact, a fixed arcing contact mounted to the fixed main contact, and a fixed resistor having an end and operative to be inserted momentarily on closure of the circuit breaker, an insertion electrode being connected by at least one arm to the end of the resistor; the enclosure also containing a moving assembly comprising a movable main contact, inner and outer coaxial cylinders fixedly connected to the movable main contact and which are mechanically secured to each other so as to move together, defining a blast volume, said moving assembly further comprising a blast nozzle and an arcing contact, wherein the blast nozzle and the arcing contact of the moving assembly are fixedly secured to each other and constitute a semi-moving subassembly which is movable relative to a remainder of the moving assembly, the insertion electrode being disposed in line with the fixed main contact and at a distance from an end of the movable main contact that is greater than an insulation distance when the circuit breaker is in the open position, the semi-moving subassembly being urged by a spring in a direction tending to move the semi-moving subassembly away from the fixed arcing contact, the distance between an end of the fixed arcing contact and an end of the arcing contact of the moving assembly, when the circuit breaker is in the open position, being greater than the distance between the insertion electrode and the end of the movable main contact.

2. The circuit breaker according to claim 1, wherein the arcing contact of the moving assembly comprises a tube that slides in the inner coaxial cylinder to which the arcing contact of the moving assembly is electrically connected by a sliding contact.

* * * * *